US006708977B2

(12) United States Patent
Jeon

(10) Patent No.: US 6,708,977 B2
(45) Date of Patent: Mar. 23, 2004

(54) PREMIUM ARCADE GAME MACHINE AND THE GAMING METHOD THEREOF

(75) Inventor: Ju Young Jeon, Yongsan-Gu (KR)

(73) Assignee: Eolith Co., Ltd., Seoul (KR)

( * ) Notice: Subject to any disclaimer, the term of this patent is extended or adjusted under 35 U.S.C. 154(b) by 133 days.

(21) Appl. No.: 10/115,639

(22) Filed: Apr. 3, 2002

(65) Prior Publication Data

US 2003/0047876 A1 Mar. 13, 2003

(30) Foreign Application Priority Data

Sep. 10, 2001 (KR) ..... 10-2001-55404

(51) Int. Cl.[7] ..... A63B 67/00
(52) U.S. Cl. ..... 273/448
(58) Field of Search ..... 273/138.3, 148 R, 273/154, 274, 281, 287, 384, 440, 441, 447–449

(56) References Cited

U.S. PATENT DOCUMENTS

| | | | | | |
|---|---|---|---|---|---|
| 1,708,734 | A | * | 4/1929 | Olander | 273/440 |
| 3,208,747 | A | * | 9/1965 | Kavakos | 273/441 |
| 4,305,582 | A | * | 12/1981 | Barton | 446/486 |
| 5,082,274 | A | * | 1/1992 | Bright | 273/138.2 |
| 5,954,340 | A | * | 9/1999 | Tedesco | 273/450 |
| 6,283,475 | B1 | * | 9/2001 | Stubben | 273/448 |

* cited by examiner

*Primary Examiner*—John M. Hotaling, II
(74) *Attorney, Agent, or Firm*—Harness, Dickey & Pierce, P.L.C.

(57) ABSTRACT

The present invention relates to a premium arcade game machine and the gaming method thereof. In more detail, it relates to a gaming method that a user rakes down as many medals heaped up on a plate as possible without knocking down a stick standing between the medals by controlling a joystick and/or up/down buttons to move a rake front/back/left/right and up/down within a given time, and the game machine.

4 Claims, 4 Drawing Sheets

PREMIUM ARCADE GAME MACHINE AND THE GAMING METHOD THEREOF

BACKGROUND OF THE INVENTION

1. Field of the Invention

The present invention relates to a premium arcade game machine and the gaming method thereof. In more detail, it relates to a gaming method that a user rakes down as many medals heaped up on a plate as possible without knocking down a stick standing between the medals by controlling a joystick and/or up/down buttons to move a rake front/back/left/right and up/down within a given time, and the game machine.

2. Description of the Related Art

In general, there are various types of arcade games such as a shooting game, a Go game, and sports games, and a user can play a game after paying a prescribed fee.

Among these arcade game machines, some machines are designed to award various gifts to users who score more than a certain preset level for attracting users, and thereby increasing the frequency of playing games.

In other words, a gift supplier is equipped in a game machine in which various gifts are allocated to corresponding levels of score or winning percentage, and when a player gets to the preset score or winning percentage during a game, it awards a corresponding gift.

For example, levels of score can be specified to be 100,000 points, 300,000 points, 500,000 points and so on. Different gifts are allocated to different corresponding levels. And, when a player gets to a certain level of preset points described above during a game, the game machine awards a corresponding gift to the player.

Here, by installing light emitting diodes around the game machine and operating them to be ON and OFF repeatedly while a gift is being awarded, the visual effect can be maximized.

Since a user has a chance to obtain a gift by simply playing a game, he (or she) becomes to be more interested at this kind of premium game than ordinary games. And thus, the frequency of playing a game machine having a gift supplier is notably increased so that the total income of a gameroom can be increased.

In these days, dance/music simulation games, such as a DDR (Dance-Dance-Revolution), have led the main stream of domestic arcade game market in Korea. However, as the dance/music simulation games recently lose their popularity rapidly, the arcade game business community including game developers, distributors, and gameroom owners becomes to be severely stagnant due to the absence of "post-DDR".

Various types of premium game machines have been proposed for substituting the dance/music simulation games, however, they cannot jump over their limit and stay in their typical stereotype game style such as a crane-game or a punching-game.

And now, gamers want to play a game having a novel feature instead of stereotype games similar to one another. In other words, a new game, which is totally different from the previous stereotype games, is required.

In addition, a new type of premium arcade game that is able to maximize the advantage of premium game is required so that everybody can easily play and enjoy the game.

SUMMARY OF THE INVENTION

The present invention is proposed to solve the problems of the prior art mentioned above. It is therefore the object of the present invention to provide a novel type gaming method by which a user controls a crane installed in a game machine to rake down the medals heaped up on a plate without knocking down a stick standing between medals, and obtains a gift when he rakes down more medals than a certain preset number.

It is another object of the present invention to provide a premium arcade game machine by which the gaming method described above is being played.

To achieve the object mentioned above, the present invention presents a premium arcade gaming method characterized by comprising the steps of:

- inserting a coin into a game machine;
- checking the number of required medals for obtaining a gift;
- raking down the medals heaped up on a plate by using a joystick and/or up/down buttons;
- judging that a stick is knocked down or still stood up while a game is being played;
- keeping raking down the medals heaped up on a plate until a certain preset game time is over as long as the stick stands still;
- judging that the preset game time is over or not;
- counting the number of medals raked down from the plate when the game time is over;
- issuing a gift exchange card corresponding to the number of medals in case that the counted number is within a preset winning range;
- terminating the game in case that the counted number does not reach a preset winning range; and
- terminating the game regardless of game time in case that the stick is knocked down during a game.

DETAILED DESCRIPTION OF THE EMBODIMENTS

Hereinafter, referring to appended drawings, the structures and the operation procedures of an embodiment of the present invention are described in detail.

Figure 1:
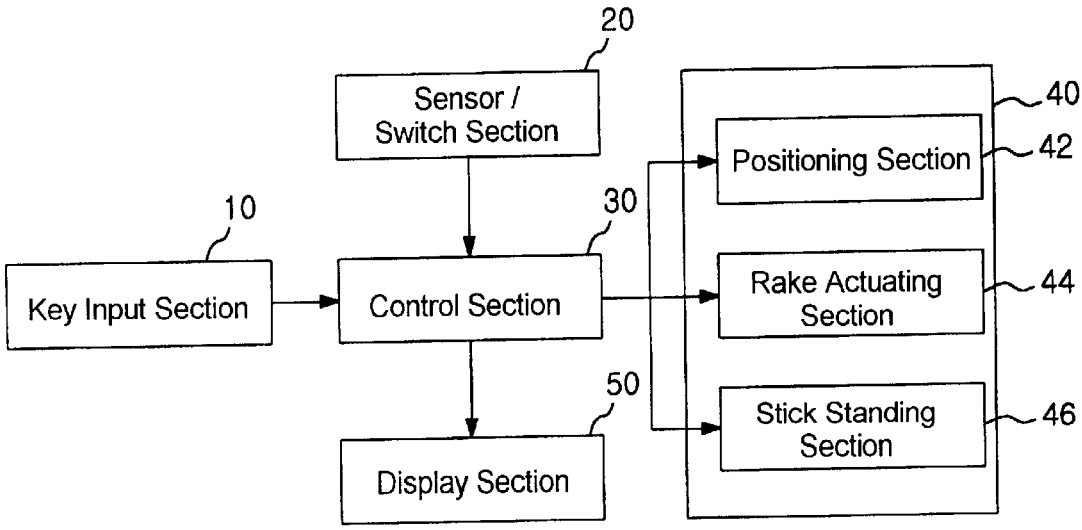
FIG. 1 is a block diagram illustrating a premium arcade game machine for raking down medals without knocking down a stick standing between medals in accordance with the present invention.
Figure 2:
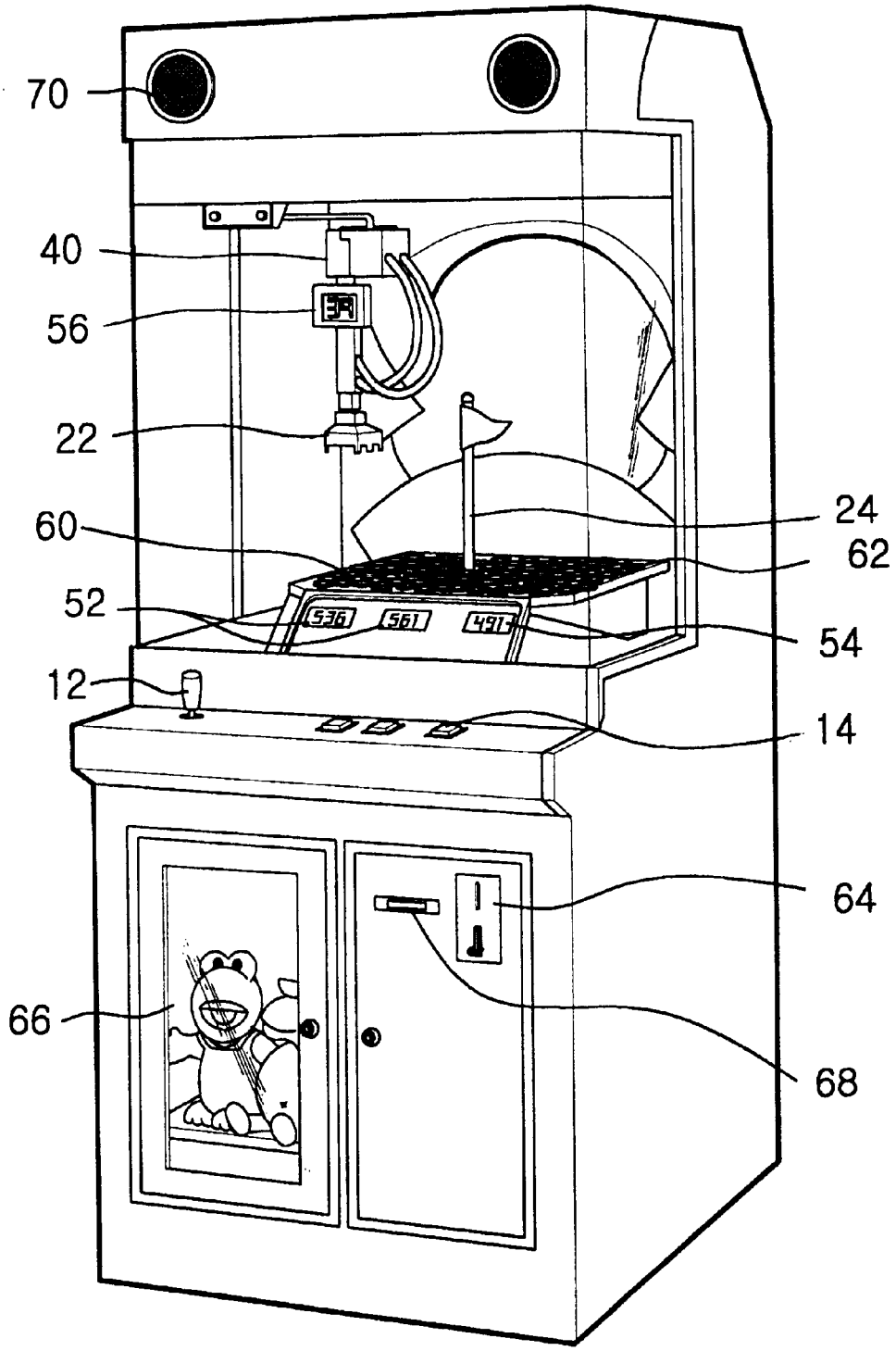
FIG. 2 is a perspective view illustrating a premium arcade game machine for raking down medals without knocking down a stick standing between medals in accordance with the present invention.

FIG. 1 is a block diagram illustrating a premium arcade game machine for raking down medals without knocking down a stick standing between medals in accordance with the present invention. FIG. 2 is a perspective view illustrating a premium arcade game machine for raking down medals without knocking down a stick standing between medals in accordance with the present invention.

Referring to FIG. 1, an arcade game machine in accordance with the present invention comprises: a key input section (10) equipped with various key input buttons for playing a game; a sensor/switch section (20) for sensing the movement of a rake (22) and the positioning state of a stick (24); a control section (30) for controlling the movement of the rake (22) and the actuation of the stick (24) according to the output signal from the key input section (10) and the sensor/switch section (20); a motor actuating section (40) for actuating the rake (22) and the stick (24) according to the control signal from the control section (30); and a display section (50) for displaying the progressive state of current game according to the control signal from the control section (30).

The motor actuating section (40) preferably comprises: a positioning section (42) for positioning the rake (22) and the stick (24) according to the control signal from the control section (30); a rake actuating section (44) for actuating the rake (22) according to the control signal from the control section (30); and a stick standing section (46) for standing the stick (24), when it is knocked down, according to the control signal from the control section (30).

In detail, referring to FIG. 2, the key input section (10) comprises a joystick and numbers of buttons such as an UP button, a DOWN button, and a START button for playing the game.

The display section (50) is composed of light emitting diodes (LED) and comprises a window (52) for displaying the number of required medals for obtaining a gift; a window (54) for displaying the current number of medals raked down; and a window (56) for displaying the remaining game time.

In addition to the components described above, a premium arcade game machine in accordance with the present invention further comprises: medals (60) heaped up on a plate (62); a coin inserting slot (64) for inserting a coin; a gift showcase (66) in which various gifts are exhibited; a card issuing slot (68) for issuing a gift exchange card; and a speaker (70) for generating various sounds and information announcements according to the game situation.

Next, the operation procedures of the game machine described above are described in detail.

First, the values of joystick movement and/or ON/OFF values of various buttons according to user's operation on the key input section (10) are transferred to the control section (30).

The control section (30) transmits a control signal for actuating the rake (22) to the rake actuating section (44) of the motor actuating section (40).

And then, the rake (22) are actuated to move front/back/left/right by the rake actuating section (44) according to the control signal from the control section (30).

In case that the stick (24) is knocked down, the control section (30) transmits a control signal for standing the stick (24) to the stick standing section (46) of the motor actuating section (40).

Here, the sensor/switch section (20) informs the position of the rake (22) and/or the standing/knocking state of the stick (24) to the control section (30).

According to the game situation, the control section (30) transmits appropriate control signals to display section (50) for displaying the number of medals raked down, the remaining game time, and the like on the LED display.

Figure 3:
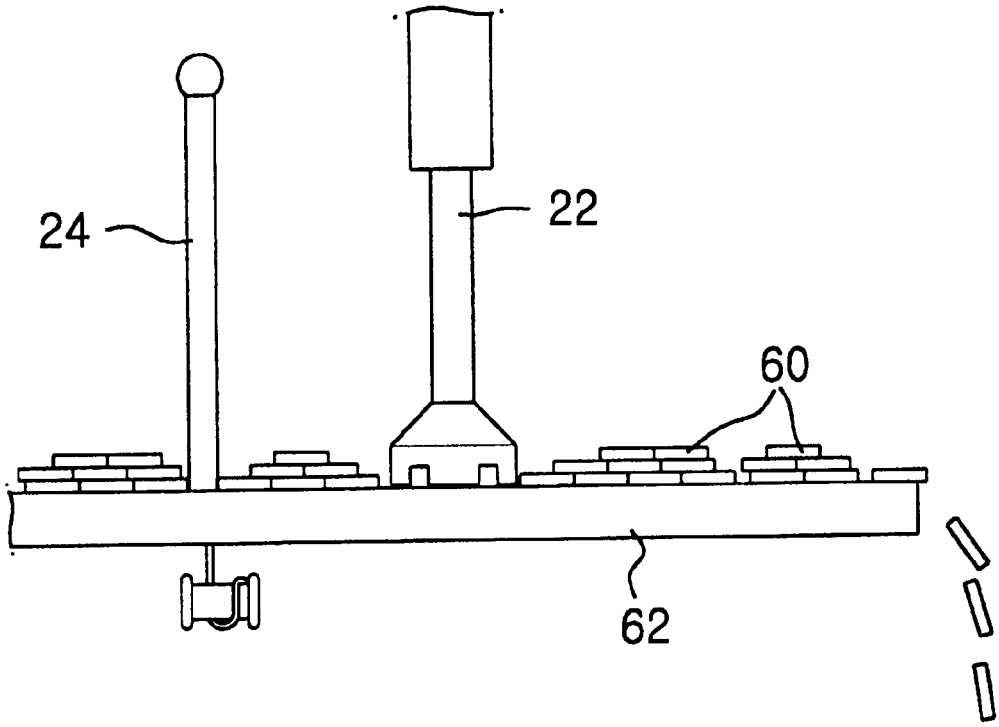
FIG. 3 is a schematic view illustrating a game playing situation for raking down medals without knocking down a stick standing between medals in accordance with the present invention.

FIG. 3 is a schematic view illustrating a game playing situation for raking down medals without knocking down a stick standing between medals in accordance with the present invention.

Referring to FIG. 3, a user pushes the START button to set a certain number of medals to be raked down to obtain a gift, and then moves the rake (22), using a joystick (12) and UP/DOWN buttons (14), to rake down the medals (60) heaped up on a plate (62) as many as possible without knocking down the stick (24) standing between the medals for a given time.

Figure 4:
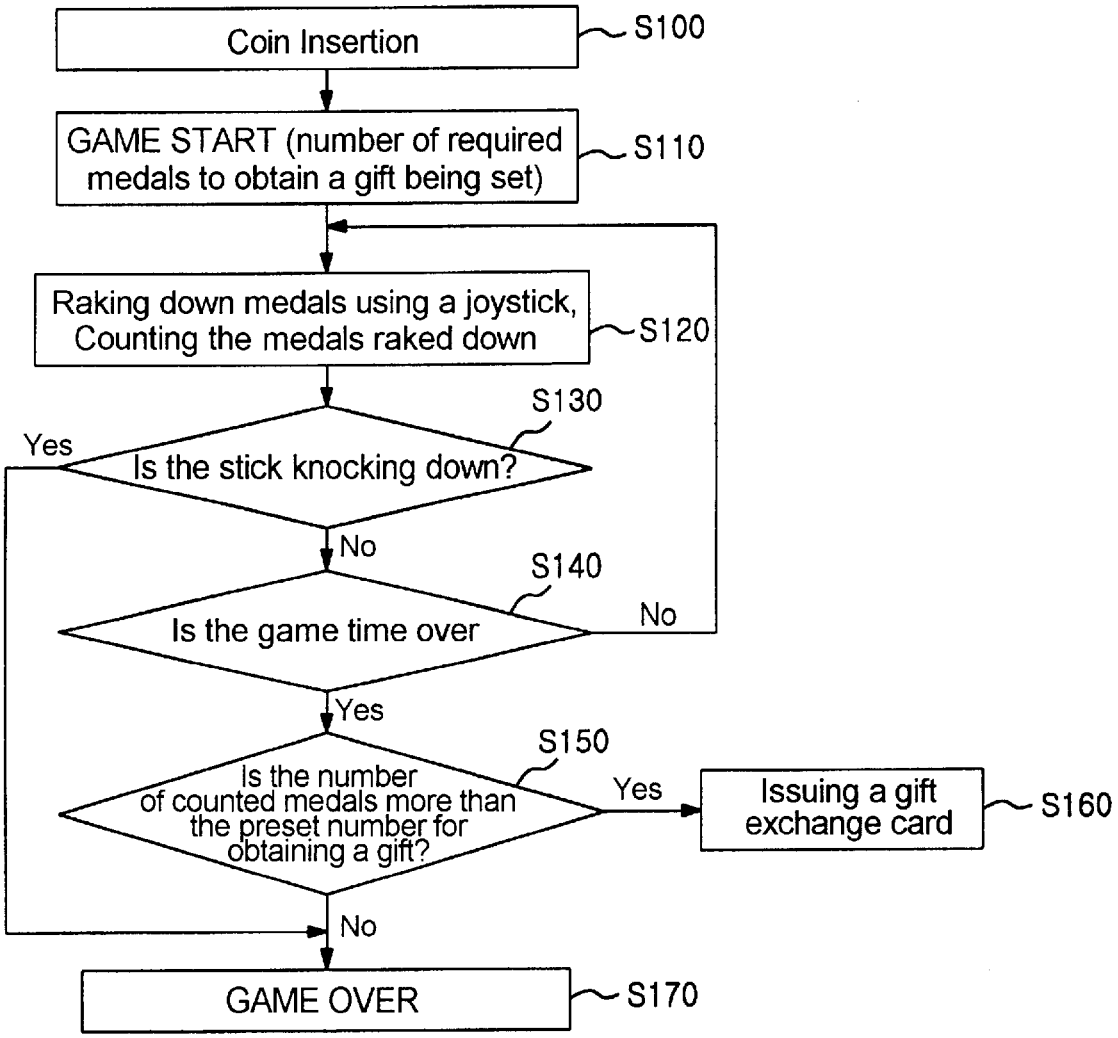
FIG. 4 is a flow chart illustrating overall gaming procedures for raking down medals without knocking down a stick standing between medals in accordance with the present invention.

FIG. 4 is a flow chart illustrating an overall gaming procedures for raking down medals without knocking down a stick standing between medals in accordance with the present invention.

First, after inserting (Step S100) a coin through the coin inserting slot (64) of the game machine, a user pushes the START button. When START button is pushed, a certain number is displayed on the window (52) for displaying the number of required medals to obtain a gift.

Here, the number of required medals to obtain a gift is randomly set and displayed (Step S110) by the time when START button is pushed.

And then, a user rakes down the medals (60) heaped up on a plate (62) by using a joystick for front/back/left/right movement and UP/DOWN buttons for up/down movement.

Here, a stick (24) is stood up on the plate (62) between the medals (60), and when a user rakes down the medals (60) using a rake (22), the number of medals raked down from the plate (62) is counted (Step S120).

During the game being played, the control section (30) checks whether or not the stick (24) is knocked down by the rake (22) or by the medals (60) (Step S130).

If the stick (24) is knocked down, the game is terminated regardless of remaining game time (Step S170)

Otherwise, when the preset game time is over (Step S140), the machine counts the number of medals (60) raked down from the plate (62) (Step S150). Here, if the counted number is more than the preset number required to obtain a gift, a user wins the game and a corresponding gift exchange card is issued through the card issuing slot (68) (Step S160).

Or, if the counted number is short for the preset number required to obtain a gift, a user loses the game and the game is terminated (Step S170).

As mentioned thereinbefore, a premium arcade gaming method that a user rakes down medals heaped up on a plate without knocking down a stick standing between the medals, and the game machine in accordance with the present invention have the following advantages:

It maximizes the easy accessibility of a premium game so that everybody can easily play the game regardless of his (or her) sex and age. Therefore, it guarantees a wide popularity, and moreover, it can reactivate the arcade game market that is currently being stagnant.

Since those having ordinary knowledge and skill in the art of the present invention will recognize additional modifications and applications within the scope thereof, the present invention is not limited to the embodiments and drawings described above.

What is claimed is:

1. A premium arcade game machine comprising:

a key input section (10) equipped with various key input buttons for playing a game;

a sensor/switch section (20) for sensing the movement of a rake (22) and the positioning state of a stick (24);

a control section (30) for controlling the movement of said rake (22) and the actuation of said stick (24) according to the output signal from said key input section (10) and said sensor/switch section (20);

a motor actuating section (40) for actuating said rake (22) and said stick (24) according to the control signal from said control section (30); and a display section (50) for displaying the progressive state of current game according to the control signal from said control section (30).

2. A premium arcade game machine as claimed in claim 1, wherein said motor actuating section (40) comprises:

a positioning section (42) for positioning said rake (22) and said stick (24) according to the control signal from said control section (30);

a rake actuating section (44) for actuating said rake (22) according to the control signal from said control section (30); and a stick standing section (46) for standing said stick (24), when it is knocked down, according to the control signal from said control section (30).

3. A premium arcade gaming method comprising the steps of:

inserting a coin into a game machine;

checking the number of required medals for obtaining a gift;

raking down the medals heaped up on a plate by using a joystick and/or up/down buttons;

judging that a stick is knocked down or still stood up while a game is being played;

keeping raking down the medals heaped up on said plate until a certain preset game time is over as long as said stick stands still;

judging that said preset game time is over or not;

counting the number of medals raked down from said plate when said game time is over;

issuing a gift exchange card corresponding to said counted number of medals in case that said counted number of medals is within a preset winning range;

terminating the game in case that said counted number of medals does not reach a preset winning range; and terminating the game regardless of said game time in case that said stick is knocked down during a game.

4. A premium arcade gaming method as claimed in claim 3, characterized in that said number of required medals for obtaining a gift is displayed by random selection among various preset numbers.

* * * * *